US010309331B2

(12) United States Patent
Hauser et al.

(10) Patent No.: US 10,309,331 B2
(45) Date of Patent: Jun. 4, 2019

(54) DEVICE AND METHOD FOR CONTROLLING A FUEL INJECTION VALVE

(71) Applicant: Continental Automotive GmbH, Hannover (DE)

(72) Inventors: Christian Hauser, Lappersdorf (DE); Gerd Roesel, Regensburg (DE); Markus Stutika, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 174 days.

(21) Appl. No.: 15/312,222

(22) PCT Filed: Mar. 31, 2015

(86) PCT No.: PCT/EP2015/057015
§ 371 (c)(1),
(2) Date: Nov. 18, 2016

(87) PCT Pub. No.: WO2015/176858
PCT Pub. Date: Nov. 26, 2015

(65) Prior Publication Data

US 2017/0089288 A1 Mar. 30, 2017

(30) Foreign Application Priority Data

May 20, 2014 (DE) ..... 10 2014 209 587

(51) Int. Cl.
*F02D 41/20* (2006.01)
*F02D 41/24* (2006.01)
*F02D 41/30* (2006.01)

(52) U.S. Cl.
CPC ..... *F02D 41/247* (2013.01); *F02D 41/20* (2013.01); *F02D 41/3005* (2013.01); *F02D 2041/2055* (2013.01)

(58) Field of Classification Search
CPC .... F02D 41/247; F02D 41/20; F02D 41/3005; F02D 2041/2055
(Continued)

(56) References Cited

U.S. PATENT DOCUMENTS 2,851,855 A * 9/1958 Gamble ..... F02K 3/00 60/39.281
3,500,799 A * 3/1970 Benson ..... F02D 37/02 123/478
(Continued)

FOREIGN PATENT DOCUMENTS

CN 103270280 A 8/2013 ..... F02D 41/24
CN 103573453 A 2/2014 ..... F02D 41/32
(Continued)

OTHER PUBLICATIONS

Wikipedia article on Capacitance; Feb. 6, 2102; wikipedia.org; pp. 1-2 of attached pdf.*
(Continued)

*Primary Examiner* — David E Hamaoui
*Assistant Examiner* — Susan E Scharpf
(74) *Attorney, Agent, or Firm* — Slayden Grubert Beard PLLC

(57) ABSTRACT

The present disclosure generally relates to internal combustion engines. The teachings thereof may be embodied in methods for the measuring of a feedback signal generated by the movement dynamics of a fuel injector in operation. A method may include: (a) generating an electrical test pulse; (b) feeding the test pulse into an actuation line connecting the output stage to the injector to an electric drive of the injector; (c) measuring an electrical response pulse generated by the actuation line in response to the test pulse; (d) identifying a characteristic feature of the measured response pulse; (e) transferring the feature to a control and evaluation
(Continued)

unit; (f) evaluating the feature; and (g) acquiring the characteristic information item about the measuring channel based on the evaluation of the transferred characteristic feature.

19 Claims, 2 Drawing Sheets

(58) Field of Classification Search
USPC ..... 123/478; 701/103
See application file for complete search history.

(56) References Cited

U.S. PATENT DOCUMENTS 3,750,632 A * 8/1973 Zechnall ..... F02D 43/00 123/350
3,763,833 A * 10/1973 Rachel ..... F02D 41/365 123/490
3,871,338 A * 3/1975 Schmidt ..... F02D 41/148 123/696
3,893,432 A * 7/1975 Krupp ..... F02D 41/1481 123/486
3,941,100 A * 3/1976 Bensch ..... F02D 41/04 123/478
4,132,203 A * 1/1979 Elpern ..... F02D 41/32 123/184.31
4,153,014 A * 5/1979 Sweet ..... F02D 41/10 123/478
4,174,694 A * 11/1979 Wessel ..... F02D 1/12 123/357
4,186,691 A * 2/1980 Takase ..... F02D 41/1481 123/325
4,502,437 A * 3/1985 Voss ..... F02D 41/04 123/357
4,788,960 A * 12/1988 Oshizawa ..... F02D 41/008 123/357
5,245,501 A * 9/1993 Locher ..... B60T 8/36 324/381
5,325,837 A * 7/1994 Laufer ..... F02D 41/403 123/449
6,145,494 A * 11/2000 Klopp ..... F02D 19/0631 123/406.32
6,192,856 B1 * 2/2001 Shioi ..... F02D 41/20 123/300
8,893,685 B2 * 11/2014 Melis ..... F02D 41/401 123/478
8,973,893 B2 3/2015 Lehner et al. ..... 251/129.06
9,624,883 B2 * 4/2017 Namuduri ..... F02M 51/0689
9,650,983 B2 5/2017 Gautier et al.
9,670,863 B2 6/2017 Nakamura
9,726,099 B2 * 8/2017 Namuduri ..... F02D 41/1401
9,863,355 B2 * 1/2018 Gopalakrishnan ..... F02D 41/20
9,932,947 B2 * 4/2018 Nehl ..... F02M 51/0625
2001/0043450 A1 11/2001 Seale et al. ..... 361/160
2011/0288662 A1 * 11/2011 Carter ..... G05B 19/33 700/32
2012/0101707 A1 * 4/2012 Kemmer ..... F02D 41/20 701/103
2013/0133748 A1 * 5/2013 Lehner ..... F02D 41/247 137/1
2014/0110508 A1 * 4/2014 Dames ..... H01F 7/1646 239/585.1
2014/0345571 A1 11/2014 Hauser et al. ..... 123/478
2015/0184626 A1 * 7/2015 Denk ..... F02D 41/2096 123/478
2015/0267662 A1 * 9/2015 Nehl ..... F02M 51/005 123/294
2015/0285175 A1 * 10/2015 Parrish ..... F02D 41/20 123/480

FOREIGN PATENT DOCUMENTS

DE 3843138 A1 6/1990 ..... B60T 8/36
DE 102010021169 A1 11/2011 ..... F02D 41/00
DE 102011087418 A1 6/2013 ..... F02D 41/20
DE 102013101916 A1 8/2013 ..... F02D 41/26
DE 102012213883 A1 2/2014 ..... F02D 41/20
KR 20140024324 A 2/2014 ..... F02D 41/14
WO 90/07188 A1 6/1990 ..... B60T 8/36
WO 2015/176858 A1 11/2015 ..... F02D 41/20

OTHER PUBLICATIONS

Korean Notice of Allowance, Application No. 2017083847048, 3 pages, dated Nov. 30, 2017.
International Search Report and Written Opinion, Application No. PCT/EP2015/057015, 16 pages, dated Jun. 11, 2015.
Chinese Office Action, Application No. 201580025697.0, 17 pages, dated Oct. 31, 2018.

* cited by examiner

DEVICE AND METHOD FOR CONTROLLING A FUEL INJECTION VALVE

CROSS-REFERENCE TO RELATED APPLICATIONS

This application is a U.S. National Stage Application of International Application No. PCT/EP2015/057015 filed Mar. 31, 2015, which designates the United States of America, and claims priority to DE Application No. 10 2014 209 587.5 filed May 20, 2014, the contents of which are hereby incorporated by reference in their entirety.

TECHNICAL FIELD

The present disclosure generally relates to internal combustion engines. The teachings thereof may be embodied in methods for the measuring of a feedback signal generated by the movement dynamics of a fuel injector in operation.

BACKGROUND

Electromagnetically driven assemblies can be operated in the so-called full stroke mode with low tolerance. Using the example of an injector for injecting fuel this operating mode means that during an injection process the needle of the injector moves up to a maximum deflection or an end position and that the mass of the injected fuel is varied by varying the duration of the electric actuation of a coil drive of the injector. This duration determines the injection time, which in turn determines the mass of the fuel which is injected or is to be injected.

A trend toward relatively small injection quantities accompanied by a simultaneously relatively high static fuel throughflow rate has led to an increase of the so-called ballistic operating mode of injectors. The ballistic injector operating mode includes a partial deflection of the injector needle in a trajectory which is predefined by electrical and constructive parameters and is free, or parabolic, after the ending of the application of magnetic force, before reaching the full stroke length. In contrast to the full stroke, the ballistic operating mode of the injector is significantly more affected by tolerances, since here both electrical and mechanical tolerances of the respective injector have a significantly greater influence on the movement profile of the injector needle than is the case in the full stroke mode.

A compensation of such injector tolerances is described, for example, in DE 38 43 138 A1 for a coil-based injector. In this context, an individual measurement of a voltage profile is carried out for each injector, which voltage profile is superimposed on the profile of the actual actuation of the respective injector and depends on the individually electrical and also mechanical properties of the respective injector. The compensation described in DE 38 43 138 A1 is based on the fact that an unavoidable feedback signal occurs at coil-operated assemblies, which feedback signal depends, by means of a coupling driven by an eddy current, between the mechanics of the injector (armature and injector needle) and the magnetic circuit (coil) of the injector. Therefore, the time profile of this feedback signal depends on the actual movement behavior of the injector needle of the respective injector.

SUMMARY

The present disclosure may be embodied in actuation devices for actuating a fuel injector and/or methods for acquiring at least one characteristic information item about a measuring channel in a system which has such an actuation device and a fuel injector. In addition, the embodiments may include methods for determining the movement behavior of such a fuel injector and to an actuation method for actuating such a fuel injector for injecting fuel into the combustion chamber of an internal combustion engine.

When the entire tolerance (of the injection behavior) of an injector is considered, the tolerance of the acquisition of the feedback signal also plays a role. The contribution of this "feedback signal acquisition tolerance" to the entire tolerance is therefore more significant, the more accurate the compensation which is to be performed on the individual properties or the individual movement behavior of an injector. Therefore, accurate compensation of the tolerance of an injector and therefore highly accurate individual actuation of an injector can be achieved only if the "feedback signal acquisition tolerance" is known individually for each injector.

Some embodiments may include an actuation device for actuating an injector (150) for injecting fuel into the combustion chamber of an internal combustion engine. The actuation device (100) may comprise: an output stage (110) for generating electric excitation of an electric drive (152) of the injector (150), which excitation can be transmitted to the electric drive (152) via an actuation line (115); a measuring unit (130) for measuring a feedback signal which is generated by the electric drive (152) in response to the electric excitation and is conducted to the measuring unit (130) via the actuation line (115); and a control and evaluation unit (140) which is coupled to the output stage (110) and the measuring unit (130). The control and evaluation unit (140) is configured to cause the output stage (110) to generate a predetermined electrical test pulse (270). The measuring unit (130) is configured to measure an electrical response pulse (280) which is generated at least by the actuation line (115) in response to the test pulse (270), and to transfer at least one identified characteristic feature (t_resp1) of the measured response pulse (280) to the control and evaluation unit (140). The control and evaluation unit (140) is also configured to evaluate the transferred characteristic feature (t_resp1) of the response pulse (280) and to acquire therefrom at least one characteristic information item about a measuring channel which comprises at least the measuring unit (130) and the actuation line (115).

In some embodiments, the control and evaluation unit (140) is configured to acquire the characteristic information about the measuring channel on the basis of a time (t_resp1) of occurrence of the characteristic feature.

In some embodiments, the at least one characteristic feature of the measured response pulse (280) comprises at least one of the following features which are present in a curve profile of the response pulse (280): reaching a threshold value, a local or absolute maximum, a local or absolute minimum, a predefined gradient, an inflection point, a zero crossover.

In some embodiments, the measuring unit (130) and/or the control and evaluation unit (140) are/is configured to carry out analog signal filtering, signal sampling and/or signal processing with respect to the response pulse (280).

In some embodiments, the characteristic feature occurs in the result of a voltage measurement and/or in the result of a current measurement.

In some embodiments, the test pulse (270) has a duration of less than 500 μs, in particular of less than 200 μs and/or of less than 100 μs.

In some embodiments, the test pulse (270) brings about electrical test excitation of the injector (150), which excitation is lower than 50 mJ, in particular lower than 20 mJ and/or lower than 10 mJ.

Some embodiments include actuating a further injector for injecting fuel into a further combustion chamber of the internal combustion engine, the actuation device (100) also comprising: a further output stage for generating a further electric excitation of a further electric drive of the further injector, which excitation can be transmitted to the electric drive via a further actuation line; and a further measuring unit for measuring a further feedback signal which is generated by the further electric drive in response to the further electric excitation and is conducted to the further measuring unit via the further actuation line. The control and evaluation unit is coupled to the further output stage and to the further measuring unit. The control and evaluation unit is also configured to cause the further output stage to generate a further predetermined electrical test pulse. The further measuring unit is configured to measure a further electrical response pulse which is generated at least by the further actuation line in response to the further test pulse and to transfer at least one identified further characteristic feature of the measured further response pulse to the control and evaluation unit. The control and evaluation unit is also configured to evaluate the transferred further characteristic feature of the further response pulse and to acquire therefrom at least one further characteristic information item about a further measuring channel which comprises at least the further measuring unit and the further actuation line.

In some embodiments, the control and evaluation unit (140) is configured to determine a transit time difference between (a) a first time (t_resp1) which is characteristic of a first time difference between the emission of the test pulse (270) and the reception of the response pulse (280) and (b) a second time (t_resp2) which is characteristic of a second time difference between the emission of the further test pulse (270) and the reception of the further response pulse (282).

Some embodiments may include a method for acquiring at least one characteristic information item about a measuring channel in a system having an actuation device (100), in particular an actuation device (100) as described above, and an injector (150). The method may include: (a) generating a predetermined electrical test pulse (270) by means of an output stage (110) of the actuation device (100); (b) feeding the test pulse (270) into an actuation line (115) which connects the output stage (110) to the injector (150) and which is designed to transmit, in a real operation of the injector (150), electric excitation for activating the injector (150) from the output stage (110) to an electric drive (152) of the injector (150); (c) measuring, by means of a measuring unit (130), an electrical response pulse (280) which is generated at least by the actuation line (115) in response to the test pulse (270); (d) identifying at least one characteristic feature (t_resp1) of the measured response pulse (280); (e) transferring the identified characteristic feature (t_resp1) to a control and evaluation unit (140); (f) evaluating the transferred characteristic feature (t_resp1); and (g) acquiring the at least one characteristic information item about the measuring channel on the basis of the evaluation of the transferred characteristic feature (t_resp1).

In some embodiments, the injector (150) is assigned to the measuring channel and is connected thereto, and the injector (150) is in a static operating state in which an injector needle of the injector (150) is in a stationary position.

In some embodiments, the injector (150) is disconnected from the measuring channel.

Some embodiments may include a method for determining the movement behavior of an injector (150) for injecting fuel into the combustion chamber of an internal combustion engine. The method may include: (a) acquiring at least one characteristic information item about a measuring channel in a system with an actuation device (100), in particular an actuation device (100) as claimed in claim 1, and in the injector (150) by means of the method as claimed in one of the preceding claims 10 to 12; (b) analyzing a feedback signal which is generated in response to electric excitation of the injector (150) and is measured by the measuring unit (130) taking into account the acquired characteristic information; and (c) determining the movement behavior of the injector (150) on the basis of a result of the analysis of the feedback signal.

Some embodiments may include an actuation method for actuating an injector (150) for injecting fuel into the combustion chamber of an internal combustion engine. The actuation method may include: (a) applying electric excitation to the injector (150), which excitation brings about injection of fuel into the combustion chamber of the internal combustion engine; and (b) determining the actual movement behavior of the injector (150) by means of the method as claimed in the preceding claim. The electric excitation is configured in such a way that the actual movement behavior corresponds at least approximately to a predefined movement behavior of the injector (150).

BRIEF DESCRIPTION OF THE DRAWINGS

Further advantages and features of the teachings of the present disclosure are expounded from the following exemplary description of embodiments. The individual figures of the drawing of this application are to be considered as merely schematic and not true to scale.

Figure 1:
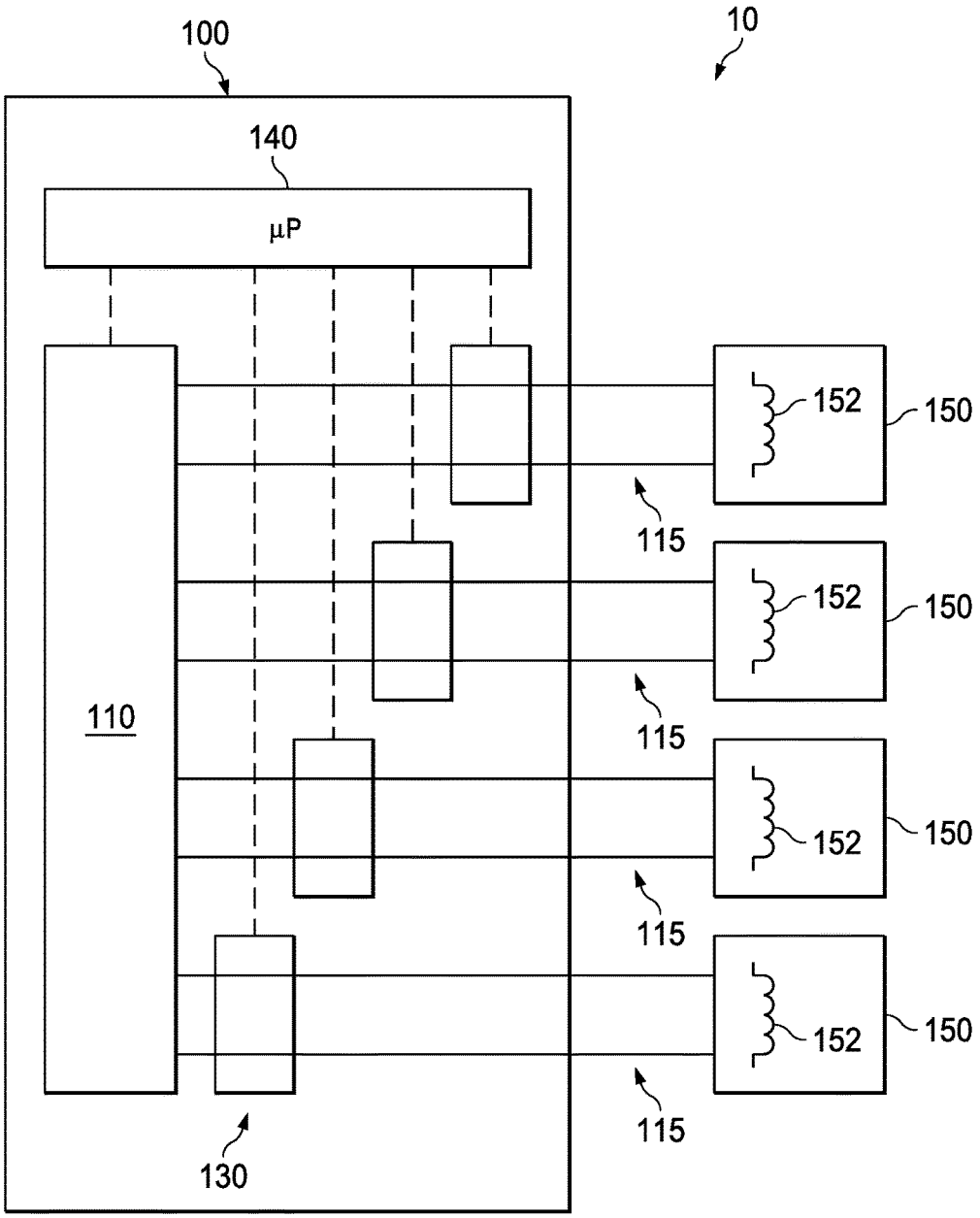
FIG. 1 shows a system having (a) an actuation device according to an exemplary embodiment of the invention and (b) a multiplicity of four injectors which are each supplied with electrical excitation by an output stage of the actuation device.

It is to be noted that the embodiment described below merely constitutes a restricted selection of possible embodiment variants of the invention.

DETAILED DESCRIPTION

The teachings of the present disclosure may be embodied in an actuation device for actuating an injector for injecting fuel into the combustion chamber of an internal combustion engine. An actuation device may comprise (a) an output stage for generating electric excitation of an electric drive of the injector, which excitation can be transmitted to the electric drive via an actuation line; (b) a measuring unit for measuring a feedback signal which is generated by the electric drive in response to the electric excitation and is conducted to the measuring unit via the actuation line; and (c) a control and evaluation unit which is coupled to the output stage and the measuring unit. The control and evaluation unit may cause the output stage to generate a predetermined electrical test pulse. The measuring unit may measure an electrical response pulse which is generated at least by the actuation line in response to the test pulse, and transfer at least one identified characteristic feature of the measured response pulse to the control and evaluation unit.

The control and evaluation unit may evaluate the transferred characteristic feature of the response pulse and acquire therefrom at least one characteristic information item about a measuring channel which comprises at least the measuring unit and the actuation line.

An actuation device may evaluate a response pulse which is generated at least by the actuation line in response to the predetermined test pulse, and evaluate the respective influence of the individual measuring channel on a change in the signal shape and/or a time shift of electrical signals. When the injector is actuated in the real injection mode with electric excitations it can be assumed that the feedback signal which is generated by the individual electric drive in response to the respective electric excitation is modified in the same way by the measuring channel. This information can be used to accurately determine the influence of the measuring channel on signal shaping of the feedback signal which is measured by the measuring unit and evaluated by the control and evaluation unit.

As a result, the influence of the measuring channel on the signal shaping can be eliminated by calculation by the control and evaluation unit and the actual feedback signal which is generated by the electric drive of the injector can be evaluated with high accuracy. This in turn permits the control and evaluation unit to modify subsequent electric excitations of the injector in such a way that the individual movement behavior of the injector needle corresponds at least approximately to a predefined movement profile which brings about a desired fuel measurement. As a result, the quantity accuracy of an injector may be improved, in particular in what is referred to as the ballistic mode in which small quantities or masses of fuel are injected.

In this document, the term "measuring channel" refers to all those components of a system for injecting fuel which are used to generate the test pulse, to transmit the test pulse, to convert the test pulse into the response pulse, to transmit the response pulse, to measure the response pulse, and/or to analyze the response pulse and to determine the characteristic feature of the response pulse. Since the measuring channel can therefore have a multiplicity of device-related elements, it can also be referred to as "measuring circuit".

In some embodiments, the actuation devices taught may identify (and compensate later by means of a suitable procedure) that error which is caused by the respective measuring channel (and expressly not by the corresponding injector) when the response pulse which is acquired within the scope of calibration is evaluated. Since this error also occurs when evaluating the feedback signal during the normal operation of the injector, the analysis of that part of the feedback signal which is not influenced by the measuring channel can be carried out with increased accuracy. As a result, the actual movement behavior of the injector needle can be determined with particularly high accuracy.

The described measuring unit may measure the electric excitation transmitted from the output stage to the respective injector via the actuation line. In addition, the described control and evaluation unit may include two units spatially and/or functionally separated from one another, depending on the specific implementation of the actuation device.

In some embodiments, the control and evaluation unit may acquire the characteristic information about the measuring channel on the basis of a time of occurrence of the characteristic feature of the response pulse. This provides in the real operation the possibility of easily determining transit time differences of the test pulse and of the resulting response pulse, which occur between different measuring channels, and to compensate these transit time differences by means of a suitable timing offset between different electric excitations which are transmitted via one or more actuation lines and which are assigned to different measuring channels. It is to be noted that particularly accurate determination of such transit time differences can be achieved by virtue of the fact that a plurality of characteristic features of the respective response pulse are acquired, and the times of occurrence of this plurality of characteristic features are evaluated by the control and evaluation unit. Given correspondingly high computing power even the entire curve profile of the respective response pulse can be evaluated by the control and evaluation unit.

In some embodiments, the at least one characteristic feature of the measured response pulse comprises at least one of the following features which are present in a curve profile of the response pulse: reaching a threshold value, a local or absolute maximum, a local or absolute minimum, a predefined gradient, an inflection point, a zero crossover. The at least one characteristic feature is a feature of the curve profile of the response pulse which can easily be identified by the measuring unit and/or by the control and evaluation unit. If the characteristic feature is the reaching of a threshold value, it may be significant whether this threshold value is reached from below or from above. The same applies if the characteristic feature is a zero crossover.

In some embodiments, the measuring unit and/or the control and evaluation unit may carry out analog signal filtering, signal sampling, and/or signal processing with respect to the response pulse. In this way, the response pulse can be measured accurately, and the characteristic feature can be identified with a high level of reliability. As a result, it is possible to avoid, or at least reduce, incorrect identifications in which either a characteristic feature which is not present is incorrectly identified or a characteristic feature which is present is incorrectly not identified. In particular, the time of occurrence of the characteristic feature can be determined with a particularly high level of accuracy by virtue of the handling (filtering, sampling, processing) of the signal of the response pulse which is described here.

In some embodiments, the characteristic feature occurs in the result of a voltage measurement and/or in the result of a current measurement. In the case of the measurement of merely one of the two measurement variables of the voltage and the current, the voltage present at the actuation line of the respective injector may be measured by the measuring unit. Therefore, the accuracy during the determination of the closing time of the respective injector can be improved compared to known methods for determining the closing time. If a plurality of characteristic features of the response pulse are measured by the measuring unit, wherein at least one characteristic feature occurs in the result of a voltage measurement and at least one other characteristic feature occurs in the result of a current measurement, the respective measuring channel can be characterized with such accuracy that when this characterization is correspondingly taken into account in the real operation of the injector not only is the accuracy of the determination of the injection closing time increased but also the opening behavior of the respective injector can be determined with increased accuracy.

In some embodiments, the test pulse has a duration of less than 500 μs, in particular of less than 200 μs, and/or of less than 100 μs. In order to eliminate, or at least reduce, influences which are undesired during the described characterization of the measuring channel and which are caused by an injector in active operation, electric test excitation, linked to the test pulse, of the drive of the injector should be so weak that it does not bring about deflection of the injector needle.

Using a test pulse with a very short duration, the measurement or calibration of the measuring channel may not be influenced by undesired activation of the respective injector. In this context, the activation of an injector is to be understood as meaning actuation of the injector by means of electric excitation, which brings about deflection of the injector needle at least to an extent which is not negligible. In the case of such activation of the injector, the response pulse, which is assigned only to the measuring channel, may have feedback signals superimposed on it, which signals arise from the dynamics of the activated injector.

In some embodiments, the test pulse brings about electric test excitation of the injector, which excitation is lower than 50 mJ, in particular lower than 20 mJ, and/or lower than 10 mJ. As already explained above, electric test excitation of the injector which is so low that the respective injector is not activated has the advantage that the evaluation of the at least one characteristic feature of the response pulse has the result that the characteristic information which is determined therefrom relates only to the measuring channel and not to the dynamics of an activated or operating injector.

In some embodiments, the actuation device may actuate a further injector for injecting fuel into a further combustion chamber of the internal combustion engine. The actuation device may comprise (a) a further output stage for generating a further electric excitation of a further electric drive of the further injector, which further electric excitation can be transmitted to the electric drive via a further actuation line, and (b) a further measuring unit for measuring a further feedback signal which is generated by the further electric drive in response to the further electric excitation and is conducted to the further measuring unit via the further actuation line. In this context, the control and evaluation unit is coupled to the further output stage and to the further measuring unit, and the control and evaluation unit is also configured to cause the further output stage to generate a further predetermined electrical test pulse. In addition, the further measuring unit may (i) measure a further electrical response pulse which is generated at least by the further actuation line in response to the further test pulse and (ii) transfer at least one identified further characteristic feature of the measured further response pulse to the control and evaluation unit. Furthermore, the control and evaluation unit may evaluate the transferred further characteristic feature of the further response pulse and acquire therefrom at least one further characteristic information item about a further measuring channel which comprises at least the further measuring unit and the further actuation line.

The test pulse and the further test pulse can have an identical signal shape. Different measuring channels which are assigned to different injectors can be measured simultaneously. By suitable further consideration of the characteristic information about the different measuring channels for an internal combustion engine having a plurality of cylinders, it is possible to acquire the movement behavior of the different injectors during the real operation of the internal combustion engine with a high level of accuracy. In this context, the term movement behavior is intended to refer to the closing behavior of the respective injector. If appropriate, within the scope of the acquisition of the movement behavior it is possible to determine not only the closing behavior but also the opening behavior of the respective injector. To do this, it is possible to use methods for the highly accurate evaluation of the corresponding feedback signal which are known to a person skilled in the art.

The output stage described above and the further output stage described here can also be implemented with a common output stage with a plurality of output stage elements. In a corresponding way, the measuring unit and the further measuring unit can also be implemented with a common measuring unit with a plurality of measuring inputs and configured to pass on the results of measurements carried out on different response pulses to the control and evaluation unit.

Injectors can be excited electrically via a common actuation line. In the case of an internal combustion engine having at least four combustion chambers, two injectors may be assigned to one common actuation line, which injectors are spaced apart in terms of timing as far as possible from one another during the timing sequence of the actuation. In the case of a four-cylinder engine in which a first, a second, a third, and a fourth injector are activated in the sequence 1, 2, 3, and 4, the injectors 1 and 3 and the injectors 2 and 4 are respectively supplied with the corresponding electric excitation via a common actuation line. In this way it is possible to prevent the electric excitations for the different injectors and, in particular, the corresponding feedback signals from overlapping in terms of timing. The same applies, of course, also to different test pulses which are assigned to the two injectors which are combined to form a pair. In particular, this applies to the corresponding response pulses which can generally only be measured with a high level of accuracy if they do not overlap in terms of timing.

In some embodiments, the control and evaluation unit may determine a transit time difference between (a) a first time which is characteristic of a first time difference between the emission of the test pulse and the reception of the response pulse, and (b) a second time which is characteristic of a second time difference between the emission of the further test pulse and the reception of the further response pulse.

In practice, transit times of signals which propagate in the various measuring channels and/or are caused by measuring and evaluation procedures in the respective measuring channels constitute the decisive characteristic information about the respective measuring channel. For adjusting various measuring channels with respect to one another and for taking into account the resulting adjustment later during the evaluation of various feedback signals of different injectors, the transit time difference which is determined with this embodiment constitutes the most important factor, in order to easily implement such an adjustment with a high level of accuracy. In practice, reception of the corresponding response pulse can be determined by the time of occurrence of a characteristic feature of the respective response pulse. The type of characteristic feature used can be dependent on the respective application and/or in particular on the expected signal shape of the response pulse. As already specified above, various types of characteristic features can be used.

Some embodiments may comprise a method for acquiring at least one characteristic information item about a measuring channel in a system with an actuation device and an injector. The method may include (a) generating a predetermined electrical test pulse by means of an output stage of the actuation device; (b) feeding the test pulse into an actuation line which connects the output stage to the injector and which is designed to transmit, in a real operation of the injector, electric excitation for activating the injector from the output stage to an electric drive of the injector; (c)

measuring, by means of a measuring unit, an electrical response pulse which is generated at least by the actuation line in response to the test pulse; (d) identifying at least one characteristic feature of the measured response pulse; (e) transferring the identified characteristic feature to a control and evaluation unit; (f) evaluating the transferred characteristic feature; and (g) acquiring the at least one characteristic information item about the measuring channel on the basis of the evaluation of the transferred characteristic feature.

By feeding a predetermined test pulse into the actuation line and by analyzing a response pulse generated in response to the predetermined test pulse, it is easily and reliably possible to determine an error which is determined exclusively by an inadequacy of the measuring channel which cannot be entirely avoided. In common methods for individually actuating an individual injector, this error which cannot be entirely avoided brings about, in real operation of the injector, an incorrect analysis of a feedback signal which is generated in response to electric excitation of the injector and of which the actual movement behavior of the needle of the injector is indicative or characteristic. If this error which is caused only by the measuring channel is taken into account in a suitable way during the analysis of the feedback signal in the real operation of the injector, when the method described here is used the actual movement behavior of the injector needle can be determined with a particularly high level of accuracy.

In some embodiments, the injector is assigned to the measuring channel and is connected thereto. In addition, the injector is in a static operating state in which an injector needle of the injector is in a stationary position. As a result, when the method described here is carried out it is ensured that the injector needle does not move. This ensures that the response pulse is not falsified by dynamics of the moving injector. However, the influencing of the response pulse by the purely electrical behavior of the drive, which is in a fixed position, is retained. This influencing is, however, a purely stationary effect which is caused by the injector, independently of its operating state, and accordingly can also be assigned to the characteristic information about the measuring channel.

Such dynamics of an operating injector could falsify the response pulse and thus the entire characterization of the measuring channel because, as described in the introduction, eddy current effects bring about coupling between (a) the movable mechanical components of the armature and of the injector needle and (d) the magnetic circuit of the injector or of the coil. A movement of the injector needle specifically results, as is known, in a movement-specific contribution to the feedback signal which can be evaluated by means of suitable and known methods to the effect that the movement dynamics and, in particular, the time profile of the closing and/or of the opening of the injector are/is determined.

In this context, the purely electrical behavior of the drive is to be understood as meaning the typical physical characteristics of a coil which are based on its inductivity. Accordingly, what is referred to as Lenz's Law states that the inductivity of a coil delays both a rise over time and a drop over time in a current flowing through the coil. In addition, a coil is also able to store energy temporarily in the magnetic field generated by it.

In some embodiments, the injector is disconnected from the measuring channel. The injector remains switched off. This can occur, for example, through a suitable switching device which disconnects the injector temporarily from its actuation line. Separation of the injector from the actuation line and therefore from the measuring circuit to be characterized has the result that the purely electrical behavior of the electric drive of the injector which, as described above, is independent of possibly present movement dynamics of the injector does not have any influence on the characterization of the measuring channel. As a result, the measuring channel can be characterized with a particularly high level of accuracy.

Some embodiments may include a method for determining the movement behavior of an injector for injecting fuel into the combustion chamber of an internal combustion engine. The method may include: (a) acquiring at least one characteristic information item about a measuring channel in a system with an actuation device and in the injector by means of the method described above; (b) analyzing a feedback signal which is generated in response to electric excitation of the injector and is measured by the measuring unit taking into account the acquired characteristic information; and (c) determining the movement behavior of the injector on the basis of a result of the analysis of the feedback signal. The error which is identified by means of the method described above and which is caused only by inadequacies of the measuring channel which can never be entirely avoided can be taken into account or eliminated by calculation during the analysis of the feedback signal. Therefore, the movement behavior of the injector can be determined with a level of accuracy which is improved compared to known methods.

Some embodiments may include an actuation method for actuating an injector for injecting fuel into the combustion chamber of an internal combustion engine. The described actuation method comprises (a) applying electric excitation to the injector, which excitation brings about injection of fuel into the combustion chamber of the internal combustion engine; and (b) determining the actual movement behavior of the injector by means of the method described above for determining the movement behavior of an injector. The electric excitation is configured in such a way that the actual movement behavior corresponds at least approximately to a predefined movement behavior of the injector.

The quantity accuracy of metering of fuel can be improved by means of an injector by means of a precise analysis of the actual movement behavior, on the basis of accurate evaluation of the response pulse described above taking into account the error which is caused by an inadequacy of the measuring channel, the electric excitation of the injector is configured or dimensioned in such a way that the actual movement behavior corresponds at least approximately to a predefined movement behavior. The predefined movement behavior can be determined here, for example, by means of suitable preliminary testing, by injecting a desired quantity of fuel into the combustion chamber of the internal combustion engine.

It is to be noted that embodiments of the present teachings have been described with reference to different inventive subject matters. In particular, a number of embodiments are described as devices and other embodiments as methods. However, to a person skilled in the art it is immediately clear when reading this application that unless stated explicitly otherwise any desired combination of features which are associated with different types of inventive subject matters are also possible in addition to a combination of features.

Further advantages and features of the present invention emerge from the following exemplary description of currently preferred embodiments. The individual figures of the drawing of this application are to be considered as merely schematic and not true to scale. It is to be noted that the embodiment described below merely constitutes a restricted selection of possible embodiment variants of the invention.

FIG. 1 shows, integrated into a system for injecting fuel into a total of four cylinders or combustion chambers (not illustrated) of an internal combustion engine, an actuation device 100 for actuating a total of four injectors. Therefore, a predetermined quantity of fuel can be injected in a known fashion into the respective combustion chamber. It is already to be noted at this point that the teachings herein are not restricted to the application in an internal combustion engine with four cylinders. The device and methods may be used for any desired internal combustion engine which has one cylinder, two cylinders, three cylinders or, for example, six or more cylinders.

The actuation device 10 comprises an output stage 110 comprising a plurality of output stage units which are not provided with a reference symbol. These output stage units may be combined to form a common output stage 110. However, they can also be units separate from one another.

An output stage unit may be assigned one of four injectors 150 which each have an electric drive 152. The electric drives are illustrated schematically in FIG. 1 by means of their coils. The output stage 110 or the four units of the output stage 110 are configured to transmit electric excitation to the respective electric drive 150 via one of four actuation lines 115 in response to, in each case, a trigger signal which is transferred from a control and evaluation unit 140 to the respective output stage unit. In reaction to such electric excitation, the respective injector 150 is briefly opened in a known fashion, with the result that a specific quantity of fuel is injected into the respective combustion chamber.

In some embodiments, the four output stage units are configured in such a way that when necessary instead of usual electric excitation, a test pulse which is substantially smaller compared to electric excitation can be fed to the respective electric drive 152. This test pulse, which is also brought about by the control and evaluation unit 140, is so weak that it does not bring about movement of the injector needle of the respective injector 150. By means of, in each case, one measuring unit 130, the respective test pulse can be measured with respect to its occurrence in terms of time and, if appropriate, also with respect to its shape and its intensity. However, it is to be noted that this measurement of the test pulses is optional.

In FIG. 1, the functionally different components of the output stage 110 and measuring units 130 are illustrated as components which are separate from one another. It is to be noted that these components can also be implemented physically in the form of separate units. These components may be, however, implemented by means of a common electric assembly, wherein at least one of the measuring devices is integrated into the output stage.

As described above, at least the respective actuation line 115 generates, in response to a test pulse, a response pulse measured by the respective measuring unit 130. At least one characteristic feature of the response pulse is transferred to the control and evaluation unit 140 which acquires a characteristic information item about the respective measuring channel by means of the occurrence of this characteristic feature in terms of time. Such a measuring channel comprises at least the respective measuring unit 130 and the respective actuation line 115. In addition, the measuring channel can also comprise the respective output of the output stage 110 and the coil of the respective electric drive 152.

In some embodiments, the characteristic information item constitutes the time of occurrence of a characteristic feature of the response pulse. The characteristic feature can be any desired feature of a signal shape. For example, the time when a threshold value, a local or absolute maximum, a local or absolute minimum, a predefined gradient, an inflection point, and/or a zero crossover are/is reached is suitable as the characteristic feature. Such characteristic features which permit accurate chronological assignment of the occurrence of the respective response pulse are preferably used.

By means of the characteristic information about a measuring channel it is possible to determine accurately the electrical behavior of this measuring channel. As a result, tolerances which have to be assigned in principle to each measuring channel are significantly reduced. Precise knowledge of the electrical behavior of a measuring channel permits, in a real operation of an injector 150 in which the latter is subjected to electric excitations which bring about opening of the respective injector 150, precise determination of a feedback signal which is characteristic of the movement of the injector needle of the respective injector 150. As a result, the movement behavior of the respective injector can be determined with a level of accuracy which is improved compared to known methods.

It is to be noted that two injectors 150 can also be actuated in a known fashion by means of a common actuation line 115. Those two injectors 150 provided for injection processes spaced apart from one another further in terms of timing in the normal operating mode of the internal combustion engine than two injection processes of one of the two injectors 150 and of another injector 150 may then be assigned to a common actuation line 115. In this way, neither the electric excitations which are assigned to different injectors 150 nor the test signals and response signals which are assigned to different measuring channels influence one another. Generally, the tolerances of a measuring channel are reduced by virtue of the fact that the measuring channel is supplied with a predetermined test pulse. A suitable test pulse should have a signal profile which is defined as accurately as possible.

For the characterization of a measuring channel, and therefore of a reduction of the electrical tolerances of the measuring channel, appropriate procedures depend on the type and on the scope of the equipment of the respective measuring channel but may include:

(A) The measuring channel is composed of at least a number of components of the actuation device 100 and of the respective injector 150. In this case, the test pulse should be configured in such a way that there are no moving mechanical parts in the injector which would result in a change in signals, e.g., owing to induction, eddy currents, or a change in magnetic field, and therefore would also represent the injector behavior in the measurement of the response pulse. The electrical behavior of the injector should not influence the measuring of the response pulse, or as far as possible only influence it to a small extent, owing to a needle movement or a temporary storage of energy in a magnetic field of the coil of the respective drive 152 of the injector 150. Therefore, both the test pulse and the respective component of the respective measuring channel or measuring circuit may be configured so the electrical behavior of the injector 150 at the end of the respective actuation line 115 has a negligible influence.

(B) The measuring channel or the measuring circuit is composed only of the actuation device 100 and the respective actuation line 115. This means that the actuation device 100 is wired in such a way that an injector is not actuated in the measuring channel to be checked. Therefore, the influence of the injector during the characterization of the measuring channel is eliminated.

The test pulse may be measured by means of the signal path of the respective measuring channel and features or measured values of the corresponding signal curve (e.g., extreme values (maximum values, minimum values), gradients, and/or absolute values) are determined by means of a suitable algorithm. The characteristic feature or the acquired measured value is compared with a setpoint value and the difference is stored as an adaptation value and used for subsequent measurements as a correction. This may comprise approximation of time values for various signal paths or measuring channels (differences from a trigger ranging up to a characteristic value of the test pulse) and/or also approximation of absolute values (e.g., voltage levels and/or current levels).

Furthermore, an additional algorithm may provide more accurate comparability of the test pulse and actual electric excitation or actuation. If, apart from a highly different signal level, the test pulse and actual actuation or electric excitation are also otherwise different, it is possible for different transit times to occur, e.g., as a result of signal filtering, and to require transmission or comparability by means of a suitable algorithm.

The test pulses may be configured in such a way that opening (injection) of the injector does not take place. Injection with the test pulse could change the injection rate profile during the operation of an internal combustion engine in such a way that increased fuel emissions occur during the combustion of fuel. For this reason also, test pulses may be very short (shorter than 500 μs, in particular shorter than 200 μs, and/or shorter than 100 μs) or merely output a small amount of energy to the drive of the injector (less than 50 mJ, in particular less than 20 mJ, and/or less than 10 mJ).

The response pulse or response pulses may be characterized on the basis of the signals of the current and/or voltage. To measure the voltage, a voltage measurement may be carried out at a resistor. To measure the current, a voltage measurement may be carried out at a resistor.

In order to measure a test pulse and/or to adjust the current, instead of a current test pulse a voltage test pulse could be applied directly to a measuring resistor in its own measuring line on what is referred to as the low side of the respective actuation line. This separate measuring line may be configured in such a way that the respective injector which is connected to the described actuation device via the connection line is not affected by this voltage test pulse.

Figure 2:
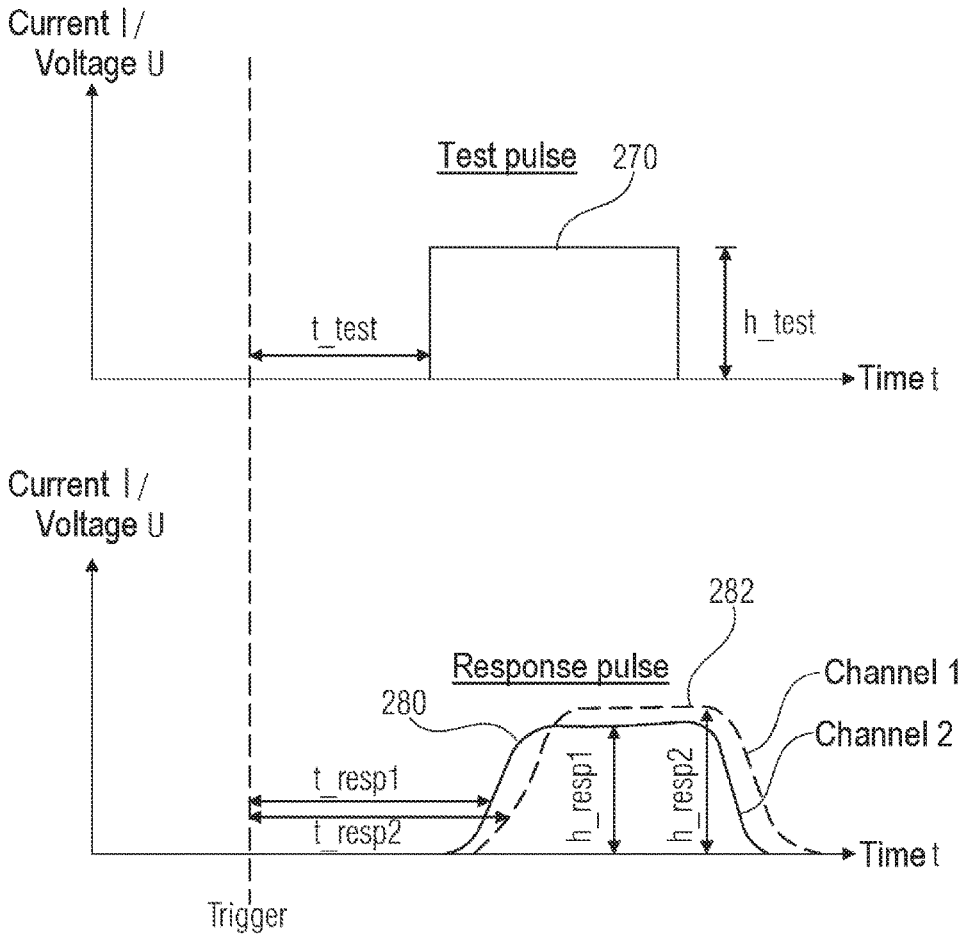
FIG. 2 shows exemplary signal profiles of a test pulse and of two response pulses which are assigned to different measuring channels.

FIG. 2 shows a possible embodiment of a test pulse with associated measured values (characteristic features) resulting from measurements and signal evaluations of a resulting response pulse. By means of an actuation device with two measuring channels (channel 1, channel 2), the identical test pulse 270 is output on each measuring channel. As is clear from the top part of FIG. 2, the test pulse 270 is at least approximately in the shape of a rectangle. In addition, the test pulse 270 starts with a time offset t_test with respect to a trigger signal which is illustrated by means of a dashed line. Furthermore, the test pulse 270 has a level which is denoted by h_test in FIG. 2.

A response pulse 280 or 282 is measured for each measuring channel by means of one measuring unit in each case. As is apparent from the bottom part of FIG. 2, the response pulses 280, 282 have flattened or rounded edges compared to the test pulse 270. Furthermore, the measured signal of the response pulse 280 differs from the measured signal of the (further) response pulse 282 by virtue of the fact that, with respect to the trigger signal, the response pulse 280 occurs with a shorter delay time t_resp1 than the response pulse 282 (delaytime t_resp2). Furthermore, the signal level h_resp1 of the response pulse 280 is lower than the signal level h_resp2 of the response pulse 282. The time period between the trigger signal to the occurrence of a threshold value of the respective response signal is different. This differing time period or differing transit times must therefore be taken into account in the precise measurement of actual injection events and suitably compensated.

In the event of absolute measured values also being important for the measurement of the signals of the response pulse, the measured signals of the test pulse can, for example, be adapted for the two measuring channels by means of suitable factors and/or an offset. The method described in this document for adapting a single-channel, two-channel or multi-channel measurement, wherein in each case a channel is assigned to an injector, may provide the following advantages:

1. It is possible to compensate component tolerances of analog signal filtering of the feedback signal, which tolerances bring about a time shift of the feedback signal and, given compensating actuation of the respective injector, result in errors in the quantity of fuel metered with an injection process. Influencing variables for such component tolerances may include manufacturing variations of the components as well as temperature drift and transit time drift.
2. Systematic tolerances which occur in the respective measuring circuit and which occur in the respective evaluation algorithm or as a result of the sampling can be compensated. Therefore it is possible to satisfy the very stringent control requirements for the operation of injectors with an overall tolerance level in the single-digit μs range.

LIST OF REFERENCE NUMBERS

100 Actuation device
110 Output stage
115 Actuation line/lines
130 Measuring unit/units
140 Control and evaluation unit
150 Injector/injectors
152 Electric drive/coil
270 Test pulse
280 Response pulse
282 Further response pulse

What is claimed is:

1. An actuation device for actuating an injector for injecting fuel into the combustion chamber of an internal combustion engine, the actuation device comprising:

an output stage generating electric excitation of an electric drive of the injector, the excitation transmitted to the electric drive via an actuation line;

a measuring unit sensing a feedback signal generated by the electric drive in response to the electric excitation and conducted to the measuring unit via the actuation line; and a control and evaluation unit coupled to the output stage and the measuring unit;

wherein the control and evaluation unit causes the output stage to generate a predetermined electrical test pulse;

the measuring unit senses an electrical response pulse generated at least by the actuation line in response to the test pulse;

the measuring unit transfers at least one identified characteristic feature of the measured response pulse to the control and evaluation unit;

wherein the control and evaluation unit evaluates the transferred characteristic feature of the response pulse and acquires therefrom at least one characteristic information item about a measuring channel which comprises at least the measuring unit and the actuation line;

wherein the injector is in a static operating state in which an injector needle of the injector is in a stationary position during application of the test pulse; and the control and evaluation unit uses the at least one characteristic information item to adjust future actuation signals to the injector.

2. The actuation device as claimed in claim 1, wherein the control and evaluation unit acquires the characteristic information about the measuring channel on the basis of a time of occurrence of the characteristic feature.

3. The actuation device as claimed in claim 1, wherein the at least one characteristic feature of the measured response pulse comprises at least one of the features of a curve profile of the response pulse chosen from the group consisting of: reaching a threshold value, a local or absolute maximum, a local or absolute minimum, a predefined gradient, an inflection point, and a zero crossover.

4. The actuation device as claimed in claim 1, wherein the measuring unit applies analog signal filtering, signal sampling, or signal processing on the response pulse.

5. The actuation device as claimed in claim 1, wherein the characteristic feature manifests as a result of a voltage measurement or a current measurement.

6. The actuation device as claimed in claim 1, wherein the test pulse has a duration of less than 500 μs.

7. The actuation device as claimed in claim 1, wherein the test pulse includes electrical test excitation of the injector lower than 50 mJ.

8. The actuation device as claimed in claim 1, further comprising:

a second injector for injecting fuel into a second combustion chamber of the internal combustion engine;

a second output stage generating a second electric excitation of a second electric drive of the second injector, the second electric excitation transmitted to the second electric drive via a second actuation line; and a second measuring unit measuring a second feedback signal generated by the second electric drive in response to the second electric excitation and conducted to the second measuring unit via the second actuation line;

wherein the control and evaluation unit is coupled to the second output stage and to the second measuring unit;

wherein the control and evaluation unit causes the second output stage to generate a second predetermined electrical test pulse;

wherein the second measuring unit measures a second electrical response pulse generated at least by the second actuation line in response to the second test pulse and transfers at least one identified second characteristic feature of the measured second response pulse to the control and evaluation unit; and wherein the control and evaluation unit evaluates the transferred second characteristic feature of the second response pulse and acquires therefrom at least one second characteristic information item about a second measuring channel which comprises at least the second measuring unit and the second actuation line.

9. The actuation device as claimed in claim 8, wherein the control and evaluation unit determines a transit time difference between (a) a first time characteristic of a first time difference between the emission of the test pulse and the reception of the response pulse and (b) a second time characteristic of a second time difference between the emission of the second test pulse and the reception of the second response pulse.

10. The actuation device as claimed in claim 1, wherein the control and evaluation unit applies analog signal filtering, signal sampling, or signal processing to the response pulse.

11. The actuation device as claimed in claim 1, wherein the test pulse has a duration of less than 200 μs.

12. The actuation device as claimed in claim 1, wherein the test pulse has a duration of less than 100 μs.

13. The actuation device as claimed in claim 1, wherein the test pulse includes electrical test excitation of the injector lower than 20 mJ.

14. The actuation device as claimed in claim 1, wherein the test pulse includes electrical test excitation of the injector lower than 10 mJ.

15. A method for controlling a fuel injector based on a characteristic information item about a measuring channel in a system having an actuation device and an injector, the method comprising:

(a) generating a predetermined electrical test pulse with an output stage of the actuation device;

(b) feeding the test pulse into an actuation line connecting the output stage to the injector and transmitting, in a real operation of the injector, electric excitation for activating the injector from the output stage to an electric drive of the injector;

(c) measuring with a measuring unit an electrical response pulse generated at least by the actuation line in response to the test pulse;

(d) identifying a characteristic feature of the measured response pulse;

(e) transferring the identified characteristic feature to a control and evaluation unit;

(f) evaluating the transferred characteristic feature; and (g) acquiring the characteristic information item about the measuring channel based at least in part on the evaluation of the transferred characteristic feature;

wherein the injector is in a static operating state in which an injector needle of the injector is in a stationary position during application of the test pulse.

16. The method as claimed in claim 15, wherein the injector is assigned to the measuring channel and is connected thereto.

17. The method as claimed in claim 15, wherein the injector is disconnected from the measuring channel during application of the test pulse.

18. A method as recited in claim 15, further comprising determining the movement behavior of an injector for injecting fuel into the combustion chamber of an internal combustion engine, by:

(a) using the characteristic information data point associated with a measuring channel in a system with an actuation device of the injector;

(b) analyzing a feedback signal generated in response to electric excitation of the injector and measured by the measuring unit influenced by the acquired characteristic information; and (c) determining the movement behavior of the injector based at least in part on a result of the analysis of the feedback signal.

19. A method as recited in claim 18, further comprising actuating an injector for injecting fuel into the combustion chamber of an internal combustion engine by:

(a) applying electric excitation to the injector to inject of fuel into the combustion chamber of the internal combustion engine; and (b) using the determined movement behavior of the injector;

wherein the electric excitation is configured in such a way that the actual movement behavior corresponds at least approximately to a predefined movement behavior of the injector.

* * * * *